US009054413B2

(12) United States Patent
Yuasa et al.

(10) Patent No.: US 9,054,413 B2
(45) Date of Patent: Jun. 9, 2015

(54) ANTENNA APPARATUS AND ELECTRONIC DEVICE INCLUDING ANTENNA APPARATUS

(71) Applicants: Tomokazu Yuasa, Akishima (JP); Hiroyuki Hotta, Ome (JP)

(72) Inventors: Tomokazu Yuasa, Akishima (JP); Hiroyuki Hotta, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 219 days.

(21) Appl. No.: 13/719,653

(22) Filed: Dec. 19, 2012

(65) Prior Publication Data

US 2013/0257661 A1 Oct. 3, 2013

(30) Foreign Application Priority Data

Mar. 30, 2012 (JP) ..... 2012-079795

(51) Int. Cl.
*H01Q 1/24* (2006.01)

(52) U.S. Cl.
CPC ..... *H01Q 1/244* (2013.01)

(58) Field of Classification Search
CPC ..... H01Q 1/24; H01Q 1/242; H01Q 1/243; H01Q 1/244
USPC ..... 343/702, 901
See application file for complete search history.

(56) References Cited

U.S. PATENT DOCUMENTS

| | | | | |
|---|---|---|---|---|
| 6,211,830 | B1 * | 4/2001 | Monma et al. | 343/702 |
| 6,380,903 | B1 * | 4/2002 | Hayes et al. | 343/725 |
| 7,006,045 | B2 * | 2/2006 | Takebe | 343/702 |
| 7,170,454 | B2 * | 1/2007 | Tefiku | 343/702 |
| 2012/0013511 | A1 | 1/2012 | Sumi et al. | |
| 2012/0075158 | A1 | 3/2012 | Kawahata | |

FOREIGN PATENT DOCUMENTS

| | | |
|---|---|---|
| JP | 07-106994 | 4/1995 |
| JP | H 09238015 | 9/1997 |
| JP | 2002-252513 | 9/2002 |
| JP | 2003-133828 | 5/2003 |
| JP | 2011120071 | 6/2011 |
| WO | WO 2010140427 | 12/2010 |

OTHER PUBLICATIONS

Japanese Patent Application No. 2012-079795, First Office Action, mailed May 7, 2013, (with English Translation).

* cited by examiner

*Primary Examiner* — Hoang V Nguyen
(74) *Attorney, Agent, or Firm* — Blakely Sokoloff Taylor & Zafman LLP

(57) ABSTRACT

According to one embodiment, an antenna apparatus includes an antenna element and a parasitic element. The antenna element includes an element main body whose first end portion is connected to a feed point and second end portion as the other end portion is open, with the element main body being configured to be selectable between a first state in which the element main body is retracted into a housing of the electronic device and a second state in which the element main body extends from the housing. The parasitic element is disposed such that when the antenna element is in the first state, the first end portion is connected to the element main body of the antenna element and the second end portion is connected to a ground portion.

10 Claims, 13 Drawing Sheets

<Extended state>

<Retracted state>

ANTENNA APPARATUS AND ELECTRONIC DEVICE INCLUDING ANTENNA APPARATUS

CROSS-REFERENCE TO RELATED APPLICATIONS

This application is based upon and claims the benefit of priority from Japanese Patent Application No. 2012-079795, filed Mar. 30, 2012, the entire contents of which are incorporated herein by reference.

FIELD

Embodiments described herein relate generally to an antenna apparatus and an electronic device including the antenna apparatus.

BACKGROUND

There have been proposals to make portable electronic devices such as personal computers and tablet type terminals incorporate radio devices for receiving analog television broadcasts, data broadcasts, mobile data broadcasts, and the like so as to allow to receive broadcast signals or data from the radio devices and display them on displays or to store them in memories.

As an antenna used in a radio device for broadcast reception, an antenna apparatus is generally used, which allows selection between a state in which an antenna element is retracted into the housing and a state in which the antenna element extends from the housing. An antenna apparatus of this type allows the user to view and listen to broadcasts while selectively using the use patterns of the antenna in accordance with surrounding conditions.

The above conventional antenna apparatus, however, has the following problem to be solved. That is, using the antenna element while keeping it outside the housing can easily obtain good characteristics. When using the antenna element while accommodating it in the housing, since the antenna element receives the influences of the ground portion on a printed wiring board set in the housing and the like, the resonance frequency shifts to a value lower than a desired value. This may lead to a deterioration in reception performance.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

FIGS. 1A and 1B are views showing the arrangement of an electronic device including an antenna apparatus according to the first embodiment, in which FIG. 1A shows a state in which an antenna element extends from the housing, and FIG. 1B shows a state in which the antenna element is retracted into the housing;

FIGS. 2A and 2B are views showing the arrangement of an electronic device including an antenna apparatus according to the second embodiment, in which FIG. 2A shows a state in which an antenna element extends from the housing, and FIG. 2B shows a state in which the antenna element is retracted into the housing;

FIGS. 3A and 3B are views showing Example 1 of an electronic device including an antenna apparatus according to the second embodiment, in which FIG. 3A shows a state in which an antenna element extends from the housing, and FIG. 3B shows a state in which the antenna element is retracted into the housing;

FIGS. 4A, 4B, 4C, and 4D are graphs showing the VSWR characteristics and gain characteristics of the antenna apparatus shown in FIGS. 3A and 3B, in which FIGS. 4A and 4B show the characteristics of the apparatus while the antenna element extends from the housing, and FIGS. 4C and 4D show the characteristics of the apparatus while the antenna element is retracted into the housing;

FIGS. 5A and 5B are views showing Example 2 of an electronic device including an antenna apparatus according to the second embodiment, in which FIG. 5A shows a state in which an antenna element extends from the housing, and FIG. 5B shows a state in which the antenna element is retracted into the housing;

FIGS. 6A, 6B, 6C, and 6D are graphs showing the VSWR characteristics and gain characteristics of the antenna apparatus shown in FIGS. 5A and 5B, in which FIGS. 6A and 6B show the characteristics of the apparatus while the antenna element extends from the housing, and FIGS. 6C and 6D show the characteristics of the apparatus while the antenna element is retracted into the housing;

FIGS. 7A and 7B are views showing the arrangement of an electronic device including an antenna apparatus according to the third embodiment, in which FIG. 7A shows a state in which an antenna element extends from the housing, and FIG. 7B shows a state in which the antenna element is retracted into the housing;

FIGS. 8A and 8B are views showing the arrangement of an electronic device including an antenna apparatus according to the fourth embodiment, in which FIG. 8A shows a state in which an antenna element extends from the housing, and FIG. 8B shows a state in which the antenna element is retracted into the housing;

FIGS. 9A, 9B, 9C, and 9D are graphs showing the VSWR characteristics and gain characteristics of the antenna apparatus shown in FIGS. 8A and 8B, in which FIGS. 9A and 9B show the characteristics of the apparatus while the antenna element extends from the housing, and FIGS. 9C and 9D show the characteristics of the apparatus while the antenna element is retracted into the housing;

FIGS. 10A and 10B are views showing Reference Example 1 of an electronic device including an antenna apparatus, in which FIG. 10A shows a state in which an antenna element extends from the housing, and FIG. 10B shows a state in which the antenna element is retracted into the housing;

FIGS. 11A, 11B, 11C, and 11D are graphs showing the VSWR characteristics and gain characteristics of the antenna apparatus shown in FIGS. 10A and 10B, in which FIGS. 11A and 11B show the characteristics of the apparatus while the antenna element extends from the housing, and FIGS. 11C and 11D show the characteristics of the apparatus while the antenna element is retracted into the housing;

FIGS. 12A and 12B are views showing Reference Example 2 of an electronic device including an antenna apparatus, in which FIG. 12A shows a state in which an antenna element extends from the housing, and FIG. 12B shows a state in which the antenna element is retracted into the housing; and FIGS. 13A, 13B, 13C, and 13D are graphs showing the VSWR characteristics and gain characteristics of the antenna apparatus shown in FIGS. 12A and 12B, in which FIGS. 13A and 13B show the characteristics of the apparatus while the antenna element extends from the housing, and FIGS. 13C and 13D show the characteristics of the apparatus while the antenna element is retracted into the housing.

DETAILED DESCRIPTION

Various embodiments will be described hereinafter with reference to the accompanying drawings.

In general, according to one embodiment, an antenna apparatus of the embodiment is provided in an electronic device including a ground portion and a feed point in a housing, and includes an antenna element and a parasitic element. The antenna element includes an element main body whose first end portion is connected to the feed point and second end portion as the other end portion is open, with the element main body being configured to be selectable between a first state in which the element main body is retracted into the housing of the electronic device and a second state in which the element main body extends from the housing. The parasitic element is disposed such that when the antenna element is in the first state, the first end portion is connected to the element main body of the antenna element and the second end portion is connected to the ground portion.

According to this embodiment, in the second state in which the antenna element is extends from the housing, it is possible to receive broadcast waves at high gain without any influence of the housing and the like. In contrast to this, in the second state in which the antenna element is retracted into the housing, a portion of the antenna element which is located near its distal end portion is physically or electrically connected to the distal end portion (open end) of the parasitic element. As a consequence, the antenna element is forcibly grounded to the ground portion via the parasitic element, and operates as a folded antenna element having a length ½ the wavelength of a broadcast wave as a reception target in cooperation with the parasitic element. Even if, therefore, the antenna element is located near the ground portion, it is possible to reduce the influence of the ground portion on the antenna element. This makes it possible to prevent a frequency shift with respect to the resonance frequency of a broadcast wave as the reception target. In addition, the antenna element and the parasitic element operate as a folded antenna element having an element length ½ the wavelength. This can increase the reception gain (Peak Gain) of a broadcast wave as compared with when using an antenna element as an antenna element having an element length ¼ the wavelength.

That is, the embodiment can provide an antenna apparatus which can obtain good reception characteristics by suppressing a resonance frequency shift when using the antenna element while accommodating it in the housing, and an electronic device including the antenna apparatus.

First Embodiment

Figure 1A:
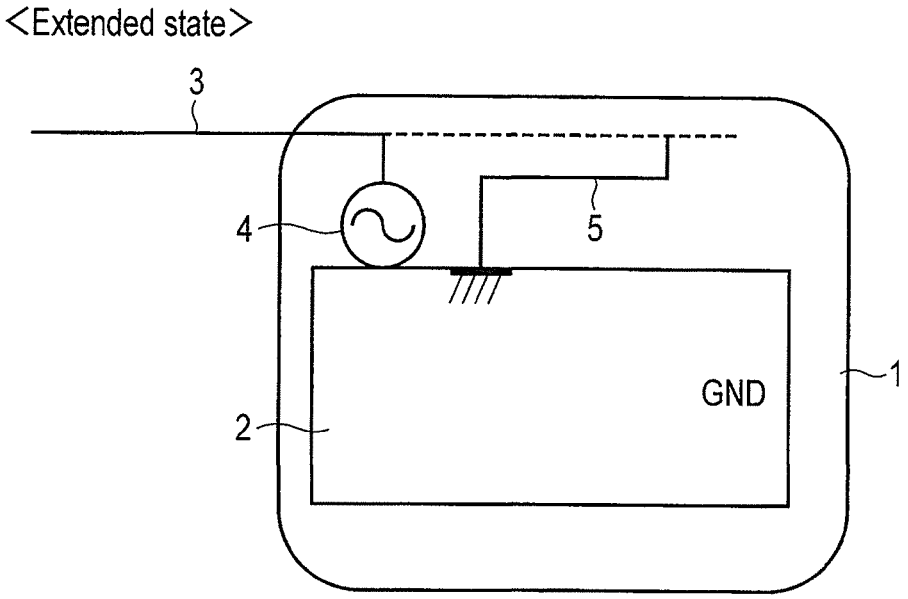
Figure 1B:
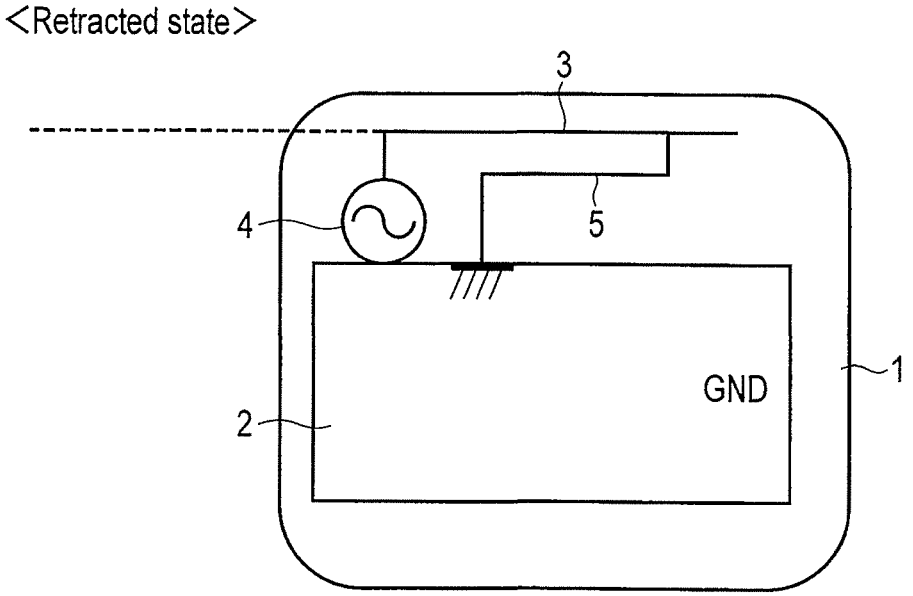

FIGS. 1A and 1B are views showing the arrangement of an electronic device including an antenna apparatus according to the first embodiment, in which FIG. 1A shows a state in which an antenna element extends from the housing, and FIG. 1B shows a state in which the antenna element is retracted into the housing.

The electronic device is formed from a notebook personal computer or portable television terminal including a radio circuit, and has a ground portion (also called a ground plate or GND plate) 2 accommodated in the housing 1. The ground portion 2 is the one using part of a metal housing or a metal member such as a copper foil, or is formed from a printed circuit board or multilayer board on which a metal ground pattern is formed.

Note that the electronic device may be a portable information terminal such as a navigation terminal, cellular phone, smart phone, PDA (Personal Digital Assistant), or tablet-type computer in addition to a notebook personal computer or portable television terminal.

An antenna apparatus is provided in this electronic device. The antenna apparatus includes an antenna element 3 and a parasitic element 5. The antenna element 3 is formed from an L-shaped linear monopole element having the proximal end portion connected to a feed point 4, and the distal end portion open. The antenna element 3 is movably mounted on the housing 1 through a connecting mechanism (not shown). This allows the antenna element 3 in the state in which it is retracted into the housing 1, i.e., the state shown in FIG. 1B, to extend from the housing 1 as shown in FIG. 1A.

On the other hand, the parasitic element 5 is obtained by folding a linear element into a crank shape, with the proximal end portion being connected to the ground portion 2. The distal end portion of the parasitic element 5 is positioned so as to be electrically connected to the antenna element 3 when the antenna element 3 is retracted into the housing 1.

This arrangement makes it possible to receive broadcast waves at high gain without any influence of the housing 1 and the like while the antenna element 3 extends from the housing 1 as shown in FIG. 1A.

In contrast, in the state in which the antenna element 3 is retracted into the housing 1 as shown in FIG. 1B, a portion of the antenna element 3 which is located near its distal end is physically or electrically connected to the distal end portion (open end) of the parasitic element 5. As a consequence, the antenna element 3 is forcibly grounded to the ground portion 2 via the parasitic element 5, and operates as a folded antenna element having a length ½ the wavelength of a broadcast wave as a reception target in cooperation with the parasitic element 5. Even if, therefore, the antenna element 3 is located near the ground portion 2, it is possible to reduce the influence of the ground portion 2 on the antenna element 3. This makes it possible to prevent a frequency shift with respect to the resonance frequency of a broadcast wave as the reception target.

In addition, the antenna element 3 and the parasitic element 5 operate as a folded antenna element having an element length ½ the wavelength. This can increase the reception gain (Peak Gain) of a broadcast wave as compared with when using the antenna element 3 as an antenna element having an element length ¼ the wavelength.

Second Embodiment

Figure 2A:
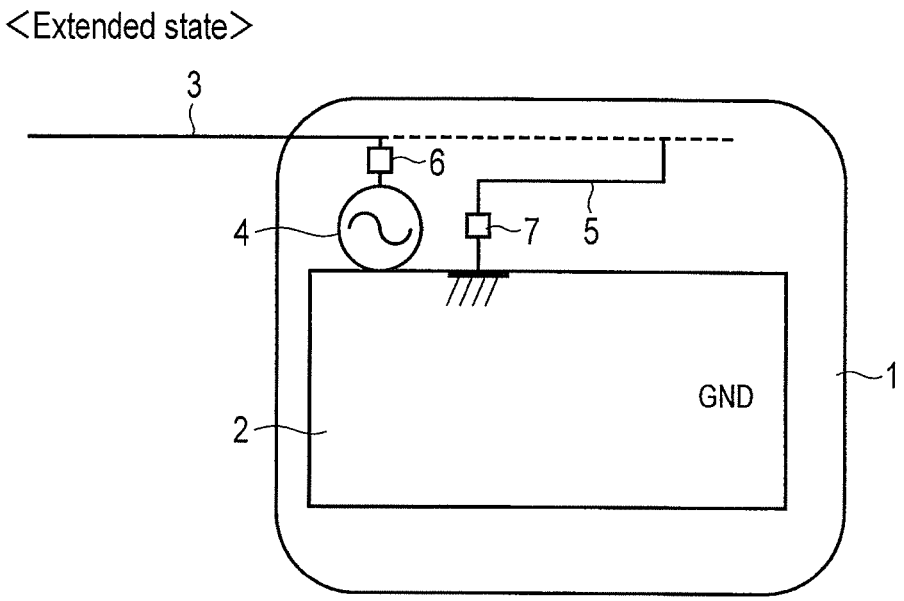
Figure 2B:
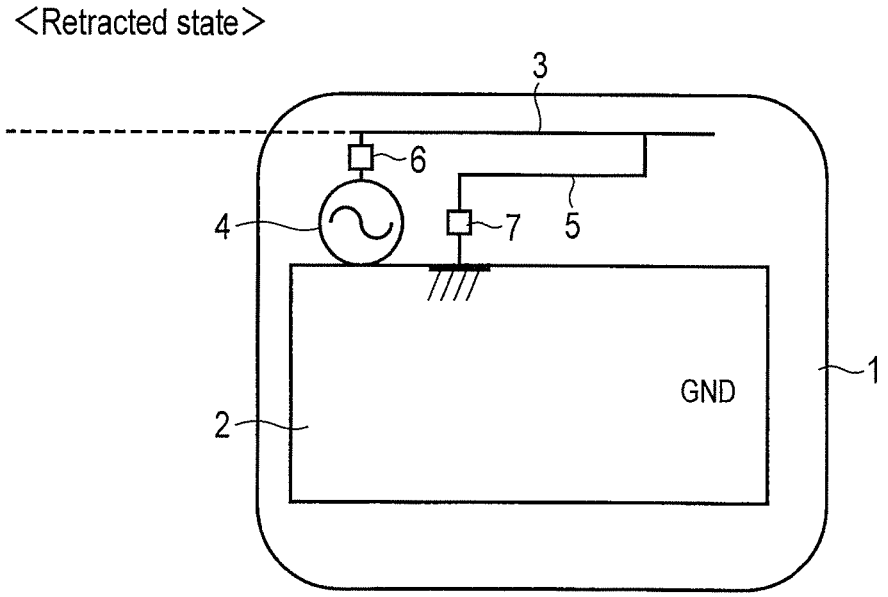

FIGS. 2A and 2B are views showing the arrangement of an electronic device including an antenna apparatus according to the second embodiment, in which FIG. 2A shows a state in which an antenna element extends from the housing, and FIG. 2B shows a state in which the antenna element is retracted into the housing. Note that the same reference numbers as in FIGS. 2A and 2B denote the same parts in FIGS. 1A and 1B, and a detailed description of them will be omitted.

A first matching circuit 6 is connected between the proximal end portion of an antenna element 3 and a feed point 4. Likewise, a second matching circuit 7 between the proximal end portion of a parasitic element 5 and a ground portion 2. The matching circuits 6 and 7 are used to match the resonance frequency of the folded antenna element constituted by the antenna element 3 and the parasitic element 5 with the frequency of a broadcast wave as a reception target.

This arrangement can accurately match the resonance frequency of the folded antenna element constituted by the antenna element 3 and the parasitic element 5 with the frequency of a broadcast wave as a reception target. In addition, connecting the first matching circuits 6 and 7 can shorten the element lengths of the antenna element 3 and parasitic element 5, thereby reducing the mounting volume of the antenna apparatus.

Examples 1 and 2 of the antenna apparatus according to the second embodiment will be described below.

(1) EXAMPLE 1

Figure 3A:
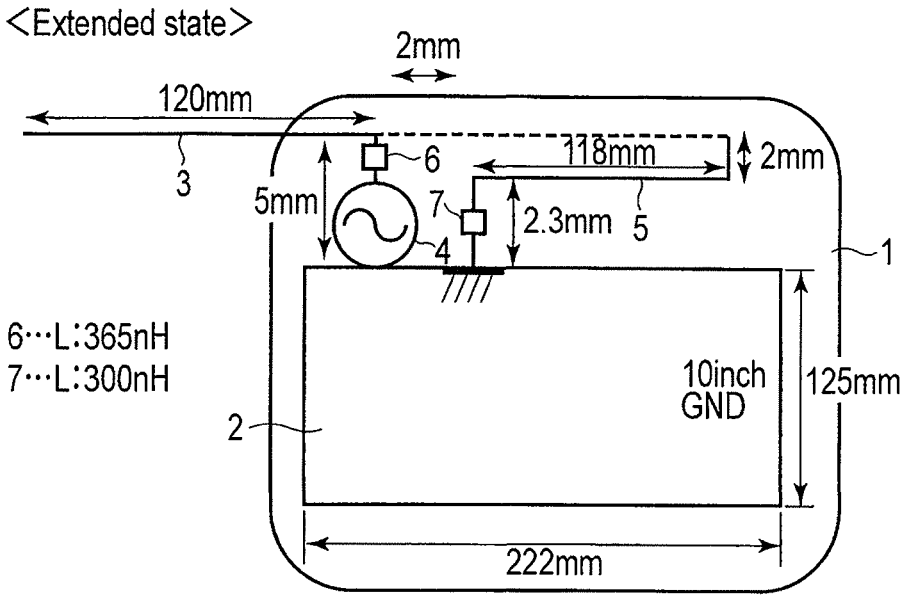
Figure 3B:
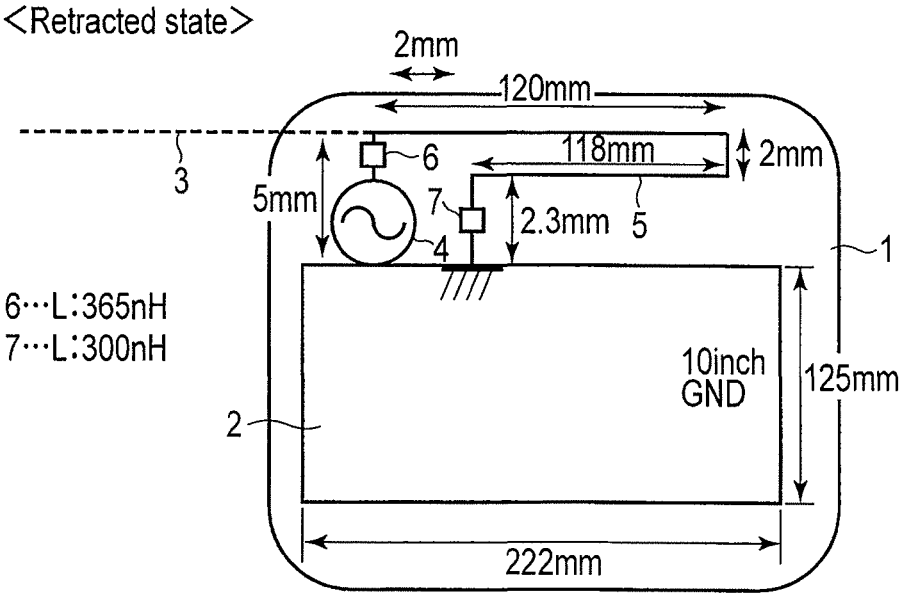

FIGS. 3A and 3B are views showing Example 1 of an electronic device including an antenna apparatus according to the second embodiment, in which FIG. 3A shows a state in which an antenna element extends from the housing, and FIG. 3B shows a state in which the antenna element is retracted into the housing.

As shown in FIGS. 3A and 3B, an antenna apparatus according to Example 1 is configured such that the element length of the antenna element 3 is set to 120 mm, the length of a portion of the parasitic element 5 which is parallel to the ground portion 2 is set to 118 mm, and a value L of an inductor serving as the second matching circuit 7 is set to 300 nH.

Figure 4A:
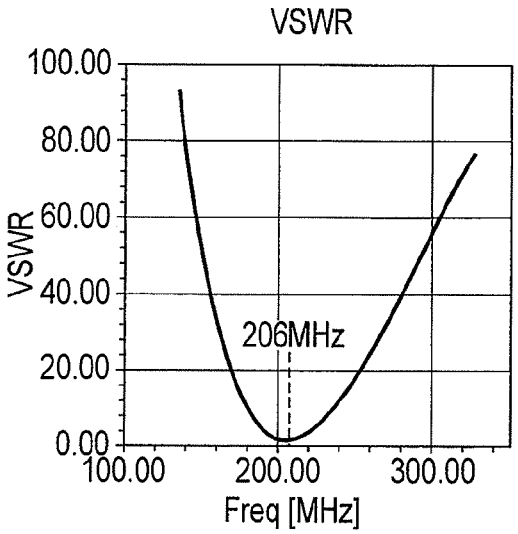
Figure 4B:
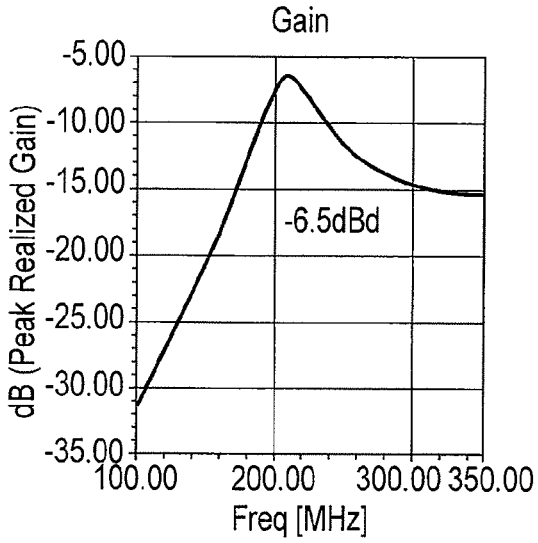
Figure 4C:
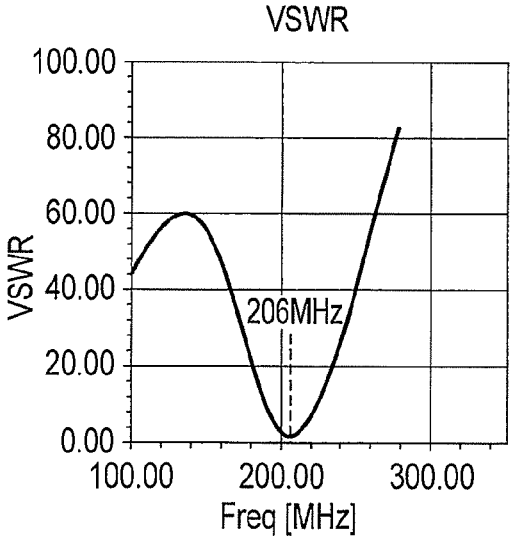
Figure 4D:
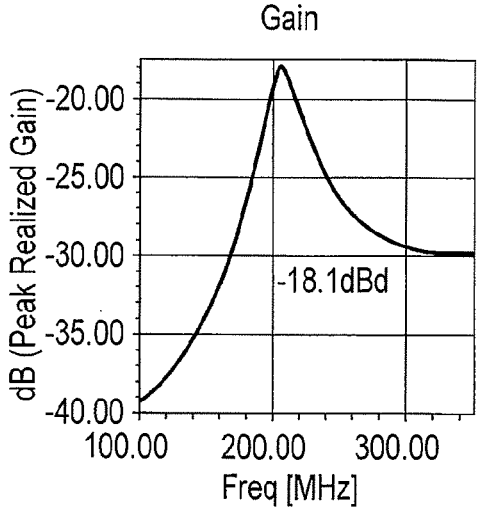

FIGS. 4A, 4B, 4C, and 4D are graphs showing the VSWR characteristics and gain characteristics of the antenna apparatus shown in FIGS. 3A and 3B, in which FIGS. 4A and 4B show the characteristics of the apparatus while the antenna element extends from the housing, and FIGS. 4C and 4D show the characteristics of the apparatus while the antenna element is retracted into the housing 1. As is obvious from FIGS. 4A, 4B, 4C, and 4D, it is possible to obtain the same resonance frequency (206 MHz) in both the state in which the antenna element 3 is retracted into the housing 1 and the state in which the antenna element 3 extends from the housing 1.

(2) EXAMPLE 2

Figure 5A:
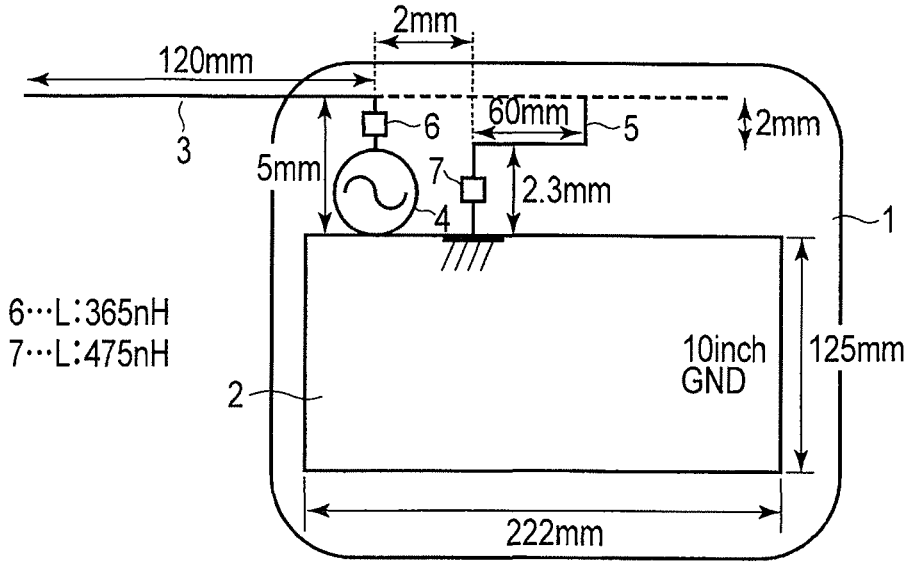
Figure 5B:
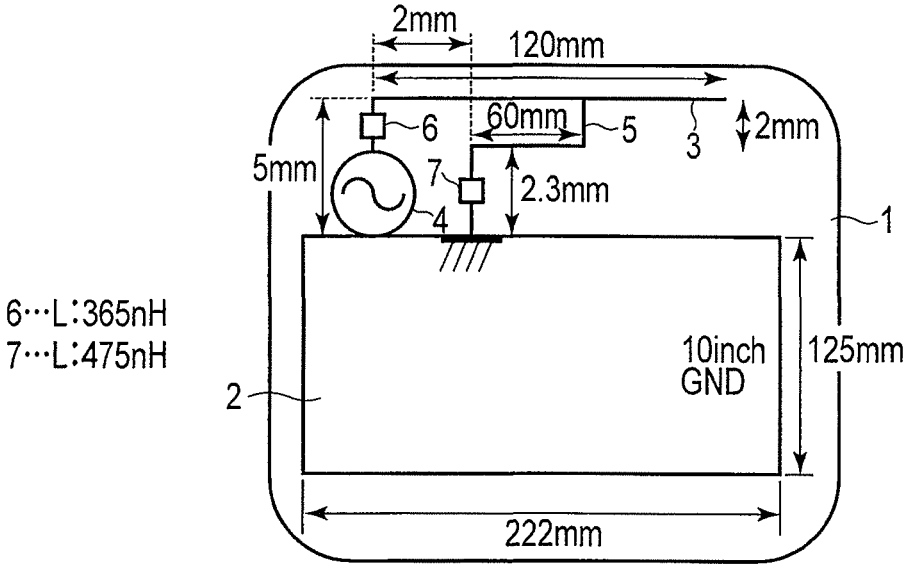

FIGS. 5A and 5B are views showing Example 2 of an electronic device including an antenna apparatus according to the second embodiment, in which FIG. 5A shows a state in which an antenna element extends from the housing, and FIG. 5B shows a state in which the antenna element is retracted into the housing.

As shown in FIGS. 5A and 5B, the element length of the antenna element 3 in the antenna apparatus according to Example 2 is 120 mm, which is equal to that in Example 1. However, the length of a portion of the parasitic element 5 which is parallel to the ground portion 2 is set to 60 mm, and the inductance value L of the second matching circuit 7 is set to 475 nH.

Figure 6A:
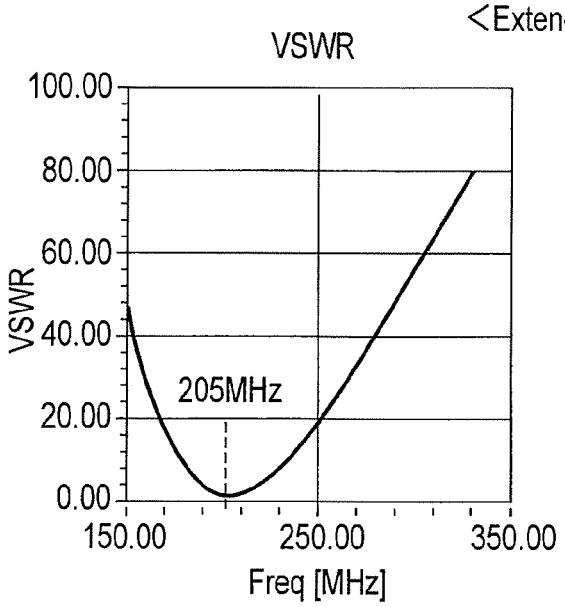
Figure 6B:
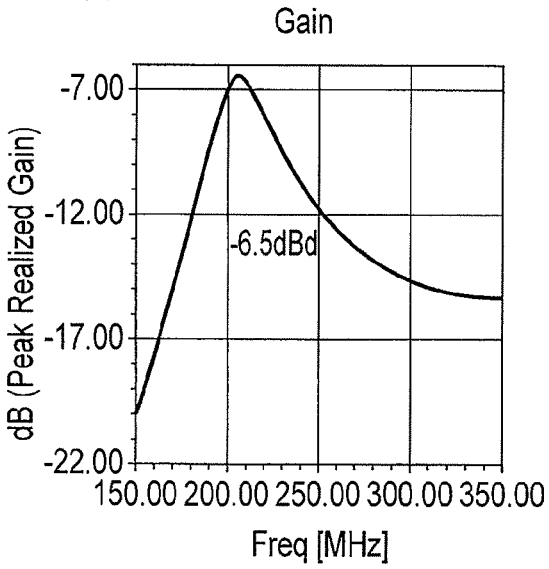
Figure 6C:
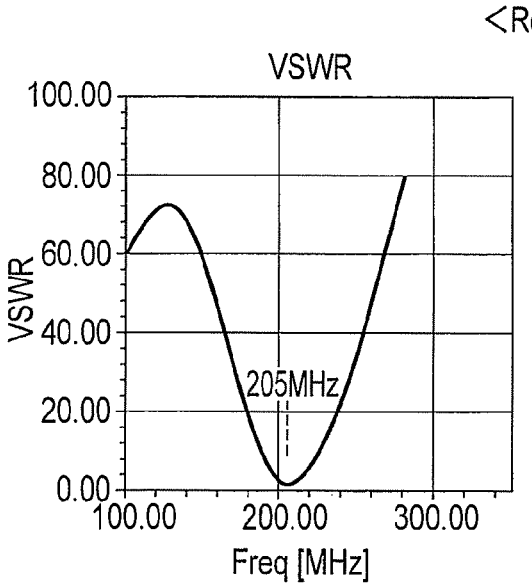
Figure 6D:
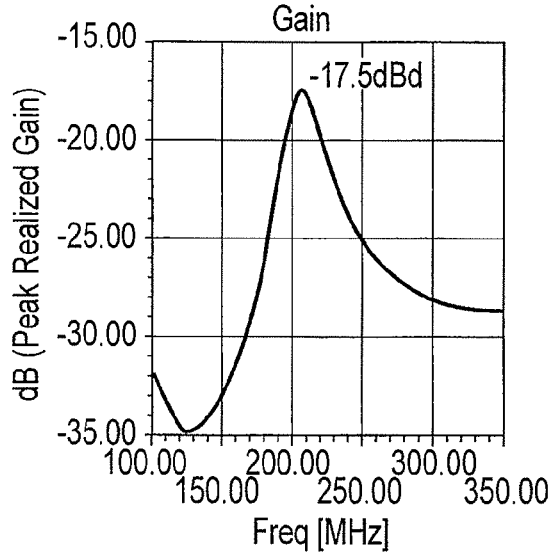

FIGS. 6A, 6B, 6C, and 6D are graphs showing the VSWR characteristics and gain characteristics of the antenna apparatus shown in FIGS. 5A and 5B, in which FIGS. 6A and 6B show the characteristics of the apparatus while the antenna element extends from the housing, and FIGS. 6C and 6D show the characteristics of the apparatus while the antenna element is retracted into the housing. As is obvious from FIGS. 6A, 6B, 6C, and 6D, it is possible to obtain the same resonance frequency (205 MHz) in both the state in which the antenna element 3 is retracted into the housing 1 and the state in which the antenna element 3 extends from the housing 1.

Figure 10A:
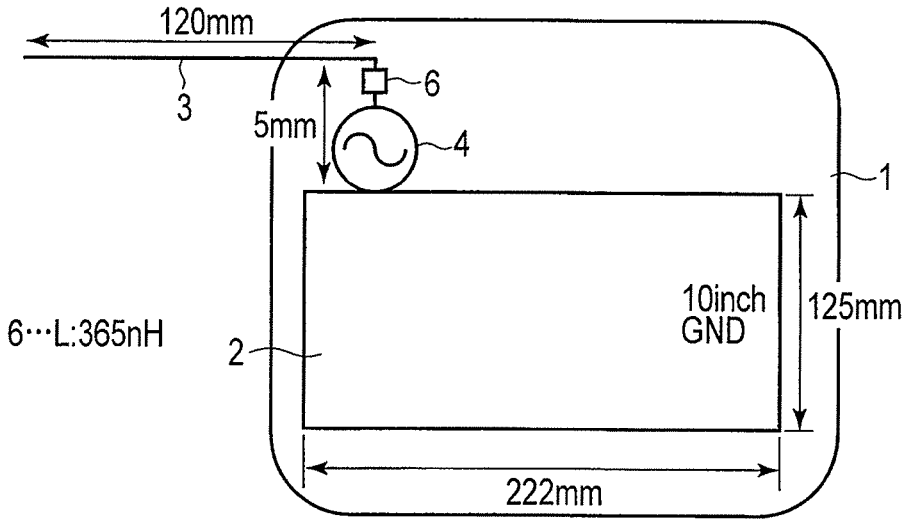
Figure 10B:
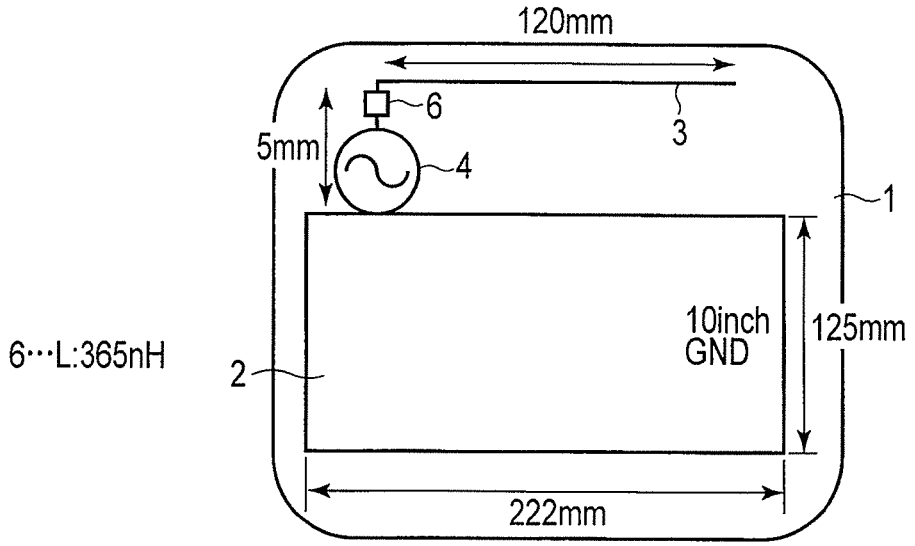
Figure 11A:
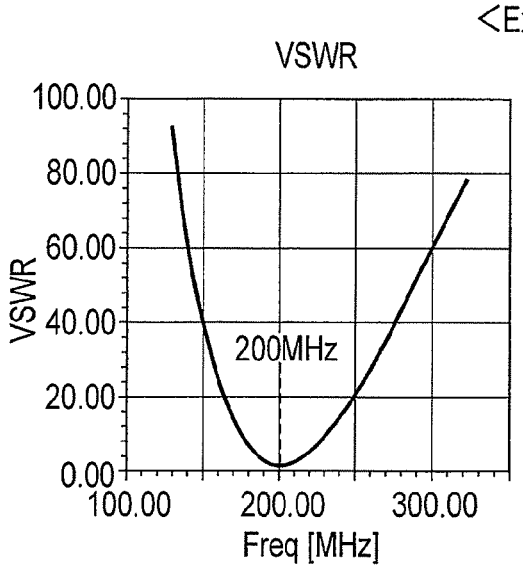
Figure 11B:
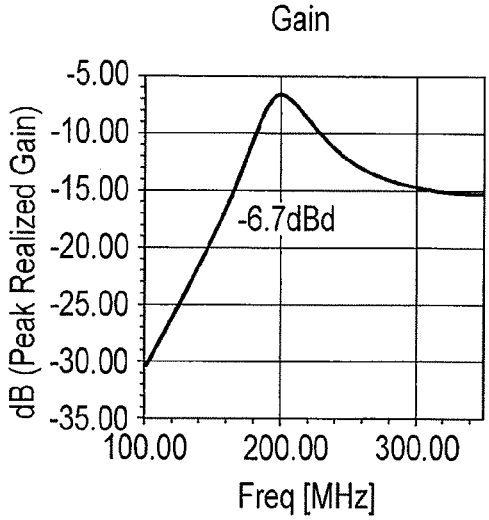
Figure 11C:
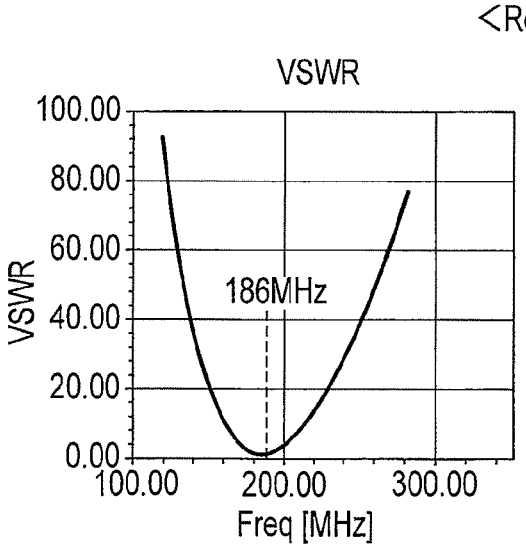
Figure 11D:
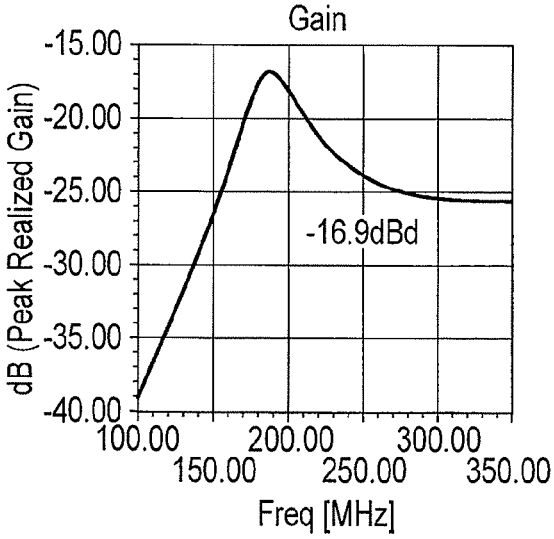
Figure 12A:
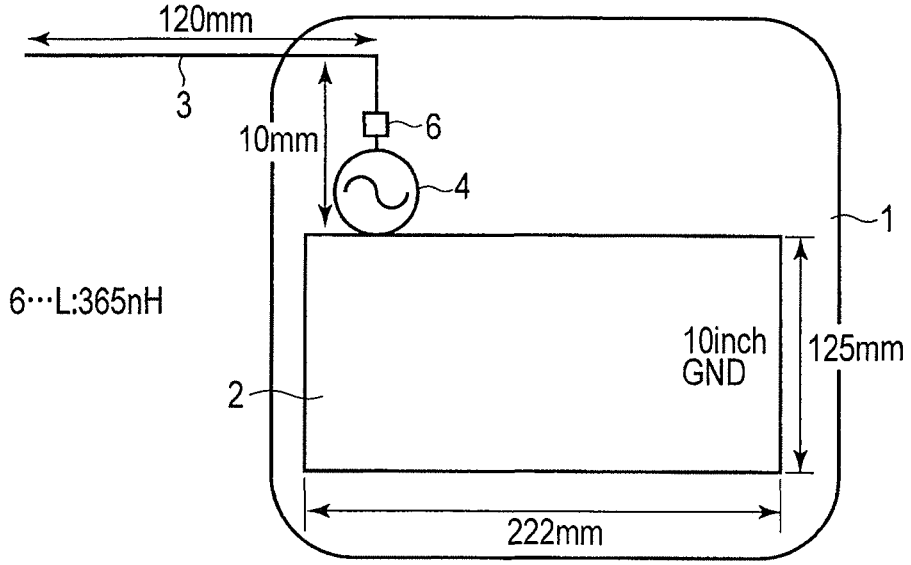
Figure 12B:
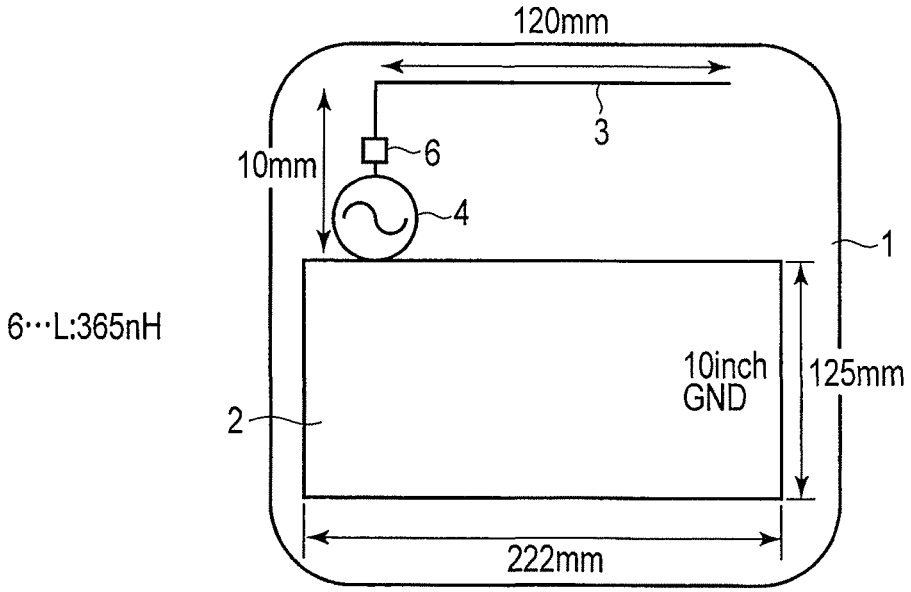
Figure 13A:
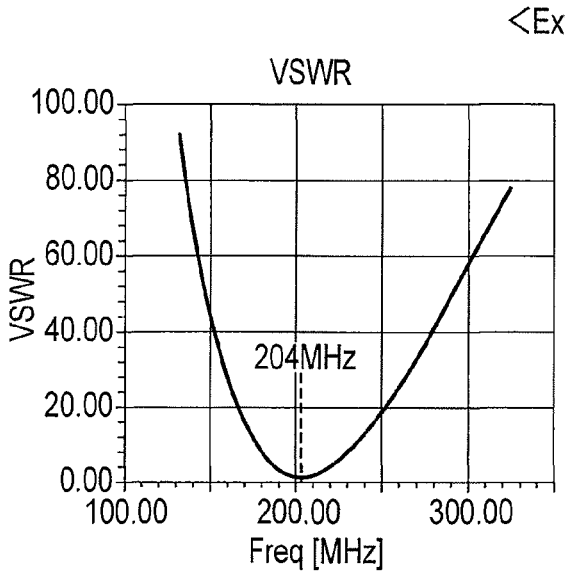
Figure 13B:
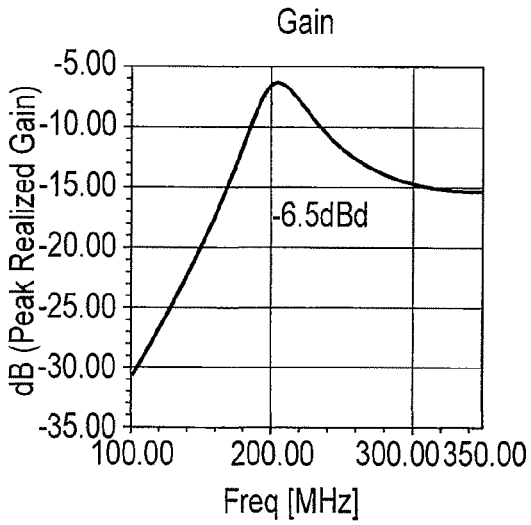
Figure 13C:
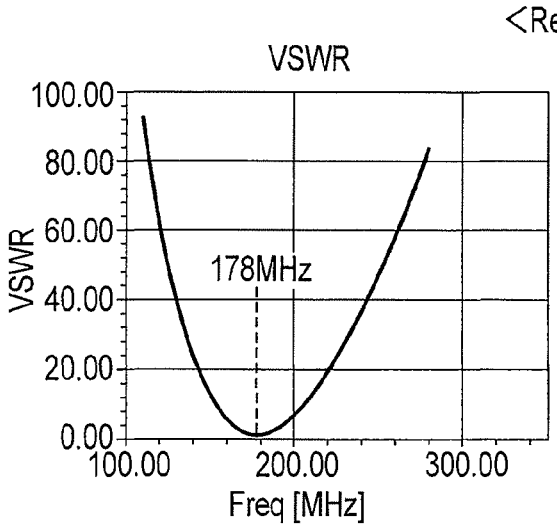
Figure 13D:
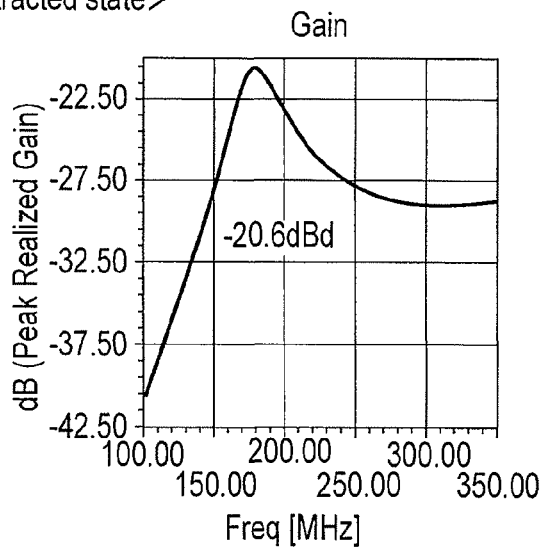

The antenna apparatuses using no parasitic element 5, shown as Reference Examples 1 and 2 in FIGS. 10A and 10B and FIGS. 12A and 12B, obtain the VSWR characteristics shown in FIGS. 11A and 11C and FIGS. 13A and 13C, respectively. FIGS. 11B, 11D, 13B and 13D are graphs showing the gain characteristics of the antenna apparatus. That is, when the distance between the antenna element 3 and the ground portion 2 is 5 mm as shown in FIGS. 10A and 10B, a frequency shift of 14 MHz occurs between the resonance frequency in the case in which the antenna element 3 extends from the housing 1 and the case in which the antenna element 3 is retracted into the housing 1, as shown in FIGS. 11A and 11C. In addition, when the distance between the antenna element 3 and the ground portion 2 is 10 mm as shown in FIGS. 12A and 12B, a frequency shift of 26 MHz occurs between the resonance frequency in the case in which the antenna element 3 extends from the housing 1 and the case in which the antenna element 3 is retracted into the housing 1, as shown in FIGS. 13A and 13C.

As is obvious from the above comparison, the antenna apparatus according to the second embodiment can obtain a very high effect of improving a frequency shift by adding the parasitic element 5 to the antenna element 3 so as to make it operate as a folded antenna element.

Third Embodiment

Figure 7A:
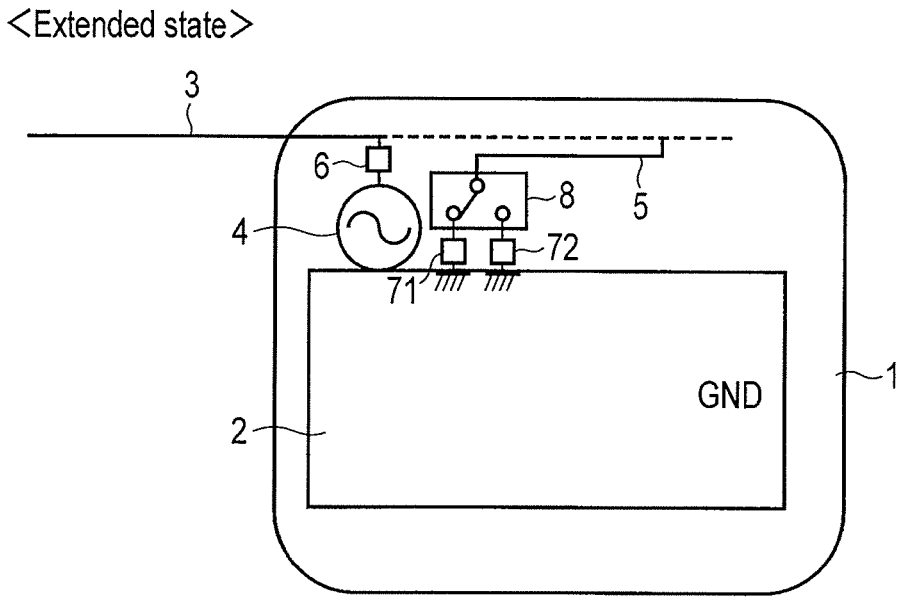
Figure 7B:
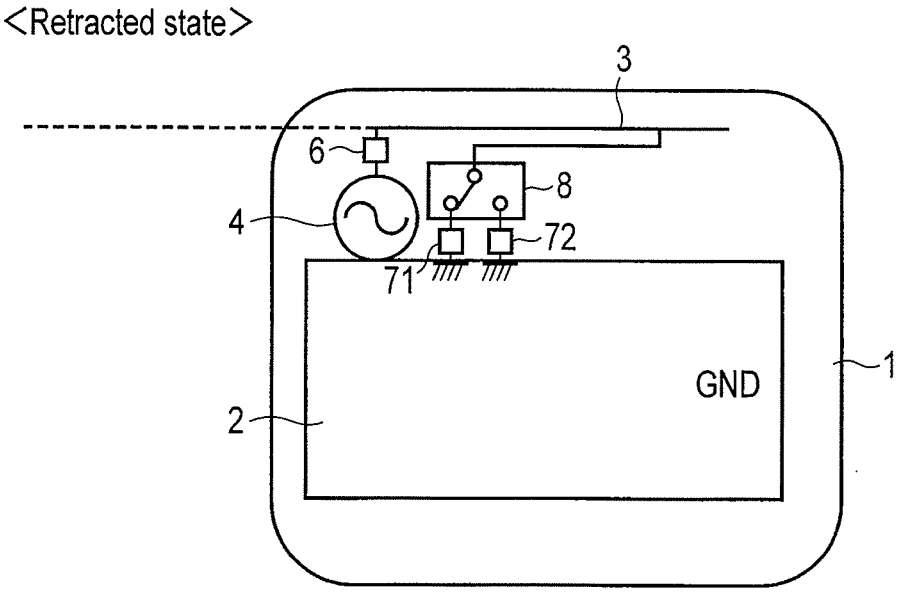

FIGS. 7A and 7B are views showing the arrangement of an electronic device including an antenna apparatus according to the third embodiment, in which FIG. 7A shows a state in which an antenna element extends from the housing, and FIG. 7B shows a state in which the antenna element is retracted into the housing. Note that the same reference numbers as in FIGS. 7A and 7B denote the same parts in FIGS. 2A and 2B, and a detailed description of them will be omitted.

A second matching circuit 7 provided between a parasitic element 5 and a ground portion 2 is constituted by two matching circuits 71 and 72 having different inductance values and a switching circuit 8. The switching circuit 8 is formed from, for example, a switch which is manually operated for switching or a semiconductor switch which performs switching operation in accordance with a switching control signal output from a control circuit (not shown). The switching circuit 8 connects one of the two matching circuits 71 and 72 between the parasitic element 5 and the ground portion 2 by switching operation.

In this arrangement, setting inductance values for the matching circuits 71 and 72 in accordance with the frequency of a system as a reception target can receive the frequency of the system as the reception target by only switching the switching circuit 8. The matching circuits 71 and 72 are switched between the parasitic element 5 and the ground portion 2. This makes it possible to maintain the high-gain antenna characteristics without any influence of the loss caused by the switching circuit 8 while the antenna element 3 extends from the housing 1.

Fourth Embodiment

Figure 8A:
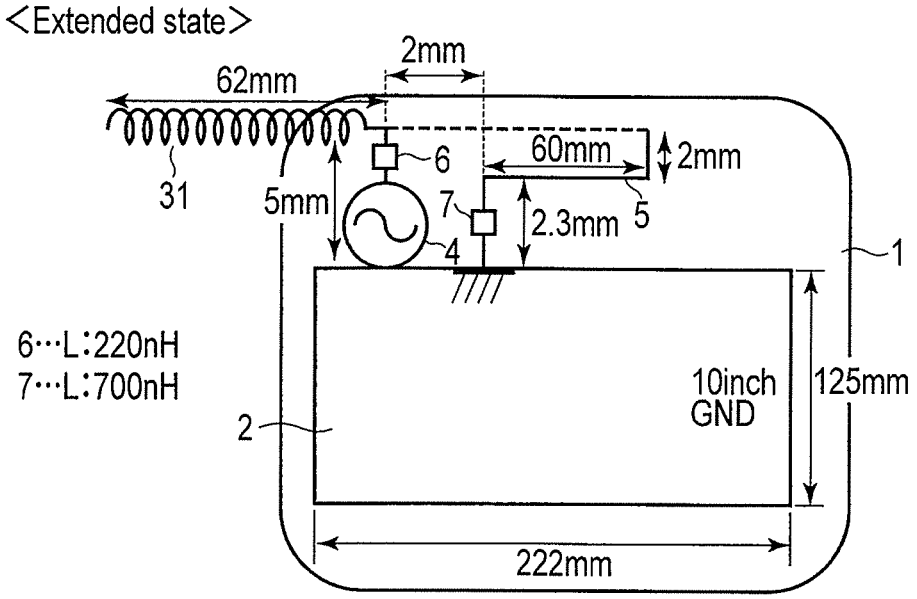
Figure 8B:
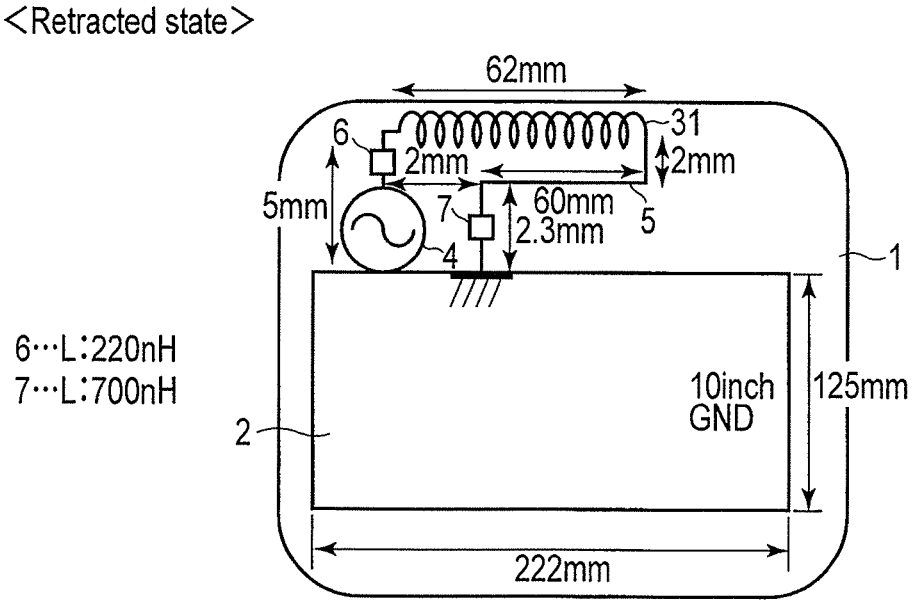

FIGS. 8A and 8B are views showing the arrangement of an electronic device including an antenna apparatus according to the fourth embodiment, in which FIG. 8A shows a state in which an antenna element extends from the housing, and FIG. 8B shows a state in which the antenna element is retracted into the housing. Note that the same reference numbers as in FIGS. 8A and 8B denote the same parts in FIGS. 2A and 2B, and a detailed description of them will be omitted.

A portion of an antenna element 3 which is parallel to a ground portion 2 is formed into a helical shape. This can decrease the element length of the antenna element 3 as compared with the case in which a linear element like that in the second embodiment is used. This makes it possible to reduce the mounting volume for antenna operation.

Figure 9A:
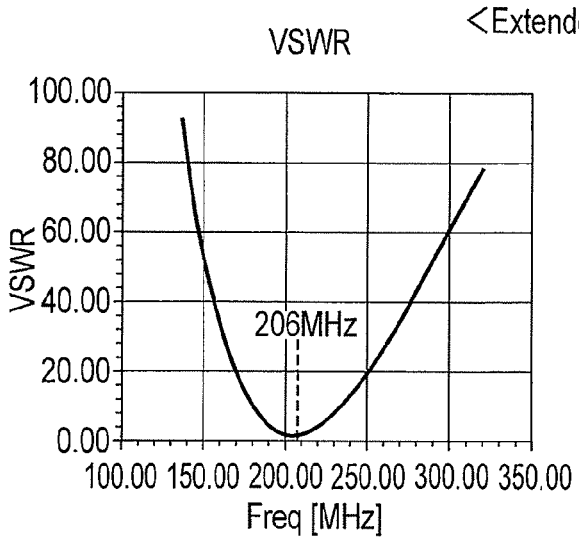
Figure 9B:
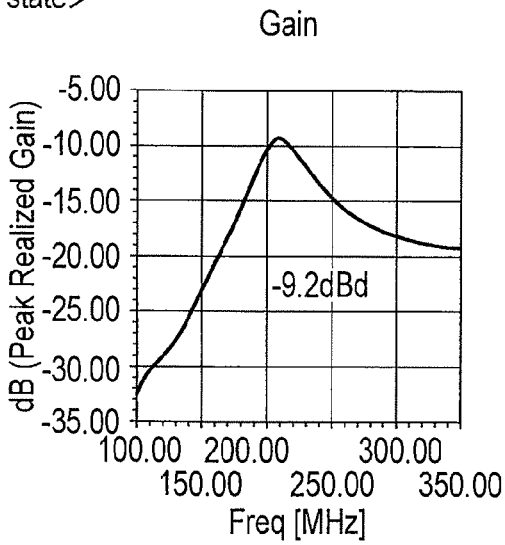
Figure 9C:
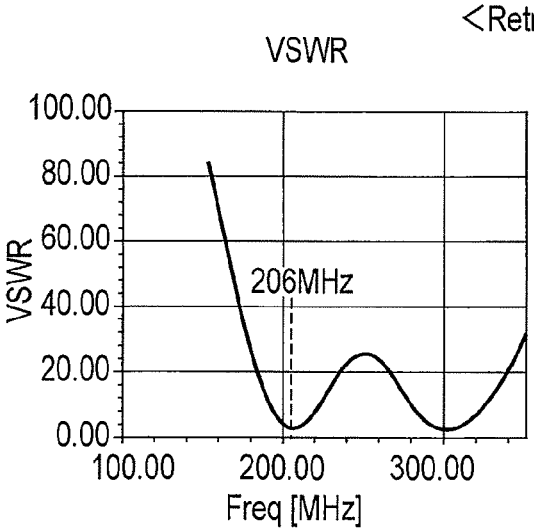
Figure 9D:
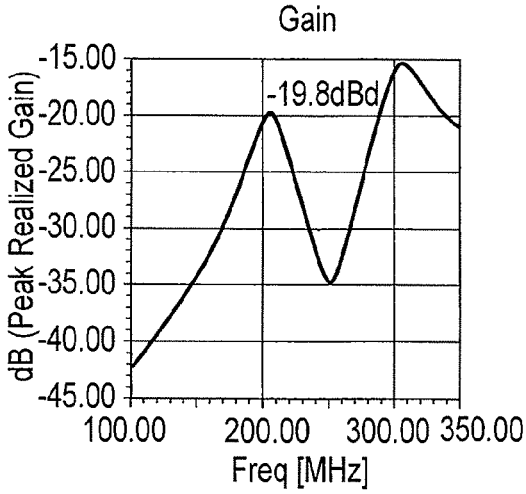

Assume that as shown in FIGS. 8A and 8B, the element length of a helical antenna element 31 is set to 62 mm, the length of a portion of the parasitic element 5 which is parallel to the ground portion 2 is set to 60 mm, and an inductance value L of the second matching circuit is set to 700 nH. This makes it possible to decrease the element length of the antenna element 3 to about ½ that in the case shown in FIGS. 3A and 3B upon setting the resonance frequency to 206 MHz as in the case shown in FIGS. 4A and 4C, as shown in FIGS. 9A and 9C.

Other Embodiments

The above embodiments have exemplified the case in which broadcast waves such as analog television broadcast, data broadcast, and mobile data broadcast waves are received. However, the embodiments can also be applied to a case in which other radio systems such as a terrestrial digital radio broadcast system, a disaster prevention broadcast system, a cellular phone network, and a wireless local area network (wireless LAN) transmit and receive radio signals.

In addition, the above embodiments can be executed by variously modifying the types and functions of electronic devices and the shapes, sizes, and the like of the antenna elements, parasitic elements, and the ground portions of the antenna apparatuses.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna apparatus in an electronic device comprising a housing comprising a ground portion and a feed point, the apparatus comprising:

an antenna element connected to the feed point, the antenna element extendable from the housing or retractable into the housing; and a parasitic element in the housing, the parasitic element comprising a first end portion connected to the ground portion and a second end portion connected to the antenna element when the antenna element is retracted into the housing, wherein the antenna element and the parasitic element operate as a folded antenna element having a length of one-half a wavelength of a broadcast wave.

2. The apparatus of claim 1, further comprising:

a first matching circuit between the antenna element and the feed point; and a second matching circuit between the parasitic element and the ground portion.

3. The apparatus of claim 2, wherein the second matching circuit comprises:

a plurality of matching elements with different impedance values; and a switching circuit which is provided between the parasitic element and the ground portion to selectively switch the plurality of matching elements.

4. The apparatus of claim 1, wherein the antenna element is formed into a helical shape.

5. An electronic device comprising:

a housing;

a ground portion in a housing;

a feed point in a housing; and an antenna apparatus, the antenna apparatus comprising an antenna element connected to the feed point, the antenna element extendable from the housing or retractable into the housing, and a parasitic element in the housing, the parasitic element comprising a first end portion connected to the ground portion and a second end portion connected to the antenna element when the antenna element is retracted into the housing, wherein the antenna element and the parasitic element operate as a folded antenna element having a length of one-half a wavelength of a broadcast wave.

6. The device of claim 5, wherein the antenna apparatus further comprises a first matching circuit between the antenna element and the feed point; and a second matching circuit connected between the parasitic element and the ground portion.

7. The device of claim 6, wherein the second matching circuit comprises:

a plurality of matching elements with different impedance values; and a switching circuit which is provided between the parasitic element and the ground portion to selectively switch the plurality of matching elements.

8. The device of claim 5, wherein the antenna element is formed into a helical shape.

9. An antenna apparatus in an electronic device including a housing that comprises a ground portion and a feed point, the apparatus comprising:

an antenna element connected to the feed point; and a parasitic element in the housing, the parasitic element comprising a first end portion connected to the ground portion and a second end portion connected to the antenna element when the antenna element is retracted into the housing, wherein the antenna element and the parasitic element operate as a folded antenna element having a length of one-half a wavelength of a broadcast wave;

a first matching circuit positioned between the antenna element and the feed point; and a second matching circuit positioned between the parasitic element and the ground portion, the second matching circuit comprises a plurality of matching elements with different impedance values and a switching circuit provided between the parasitic element and the ground portion to selectively switch the plurality of matching elements.

10. The apparatus of claim 9, wherein the antenna element is formed into a helical shape.

* * * * *